US005238766A

United States Patent [19]

Molaire et al.

[11] Patent Number: 5,238,766

[45] Date of Patent: Aug. 24, 1993

[54] COATING COMPOSITIONS CONTAINING A TITANYL FLUOROPHTHALOCYANINE PIGMENT

[75] Inventors: Michel F. Molaire, Rochester; Robert J. Patti, Webster, both of N.Y.

[73] Assignee: Eastman Kodak Company, Rochester, N.Y.

[21] Appl. No.: 834,911

[22] Filed: Feb. 13, 1992

[51] Int. Cl.[5] ..... G03G 5/06

[52] U.S. Cl. ..... 430/78; 430/135

[58] Field of Search ..... 430/58, 59, 78, 135

[56] References Cited

U.S. PATENT DOCUMENTS

| | | | |
|---|---|---|---|
| 3,041,166 | 6/1962 | Bardeen | 96/1 |
| 3,165,405 | 1/1965 | Hoesterey | 96/1 |
| 3,394,001 | 7/1968 | Malcino | 96/1.5 |
| 3,615,414 | 10/1971 | Light | 96/1.6 |
| 3,679,405 | 7/1972 | Makino et al. | 96/1.5 |
| 3,725,058 | 4/1973 | Hayashi et al. | 96/1.5 |
| 4,175,960 | 11/1979 | Berwick et al. | 430/58 |
| 4,284,699 | 8/1981 | Berwick et al. | 430/96 |
| 4,458,004 | 7/1984 | Tanikawa | 430/270 |
| 4,514,481 | 4/1985 | Scozzatava et al. | 430/58 |
| 4,578,334 | 3/1986 | Borsenberger et al. | 430/72 |
| 4,664,997 | 5/1987 | Suzuki et al. | 430/58 |
| 4,666,802 | 5/1987 | Hung et al. | 430/58 |
| 4,701,396 | 10/1987 | Hung et al. | 430/78 |
| 4,719,163 | 1/1988 | Staudenmayer et al. | 430/88 |
| 4,728,592 | 3/1988 | Ohaka et al. | 430/59 |
| 4,840,860 | 6/1989 | Staudenmayer et al. | 430/59 |
| 4,898,799 | 2/1990 | Fujimaki et al. | 430/59 |
| 5,019,473 | 5/1991 | Nguyen et al. | 430/58 |
| 5,055,368 | 10/1991 | Nguyen | 430/78 |
| 5,112,711 | 5/1992 | Nguyen et al. | 430/58 |

FOREIGN PATENT DOCUMENTS 0180931 5/1986 European Pat. Off. .

OTHER PUBLICATIONS

"A Three-Dimensional Approach to Solubility", J. D. Crowley, G. S. Teague, and J. W. Lowe, *Journal of Paint Technology*, vol. 38, No. 496, May 1966, pp. 269-280.

*CRC Handbook of Solubility Parameters and Other Cohesion Parameters*, A. Barton, CRC Press, Boca Raton, Fla., 1983, pp. 174 and 179-180.

"Near-Infrared Sensitive Electrophotographic Photoconductors Using Oxotitanium Phthalocyanine", Y. Fujimaki et al., *Journal of Imaging Technology*, vol. 17, No. 5, Oct./Nov. 1991.

*Primary Examiner*—John Goodrow

*Attorney, Agent, or Firm*—Robert Luke Walker

[57] ABSTRACT

The invention provides a coating composition comprising a coating solution of a polymeric binder and an organic solvent having a $gamma_c$ hydrogen bonding parameter value greater than 9.0, the coating solution having dispersed therein a titanyl fluorophthalocyanine pigment which has been acid-pasted or salt-milled to increase its photosensitivity and then has been brought into contact with an organic solvent having a $gamma_c$ hydrogen bonding parameter value less than 8.0 to preserve its increased photosensitivity, prior to the pigment's being dispersed in the coating solution.

10 Claims, No Drawings

COATING COMPOSITIONS CONTAINING A TITANYL FLUOROPHTHALOCYANINE PIGMENT

FIELD OF THE INVENTION

This invention relates to coating compositions useful for forming a layer comprising a polymeric binder having a titanyl fluorophthalocyanine pigment dispersed therein. More particularly, the invention relates to such coating compositions which are especially useful for forming a photoconductive layer having high photosensitivity and which can contain a coating solvent that is environmentally non-objectionable.

BACKGROUND

In electrophotography an image comprising a pattern of electrostatic potential (also referred to as an electrostatic latent image), is formed on a surface of an electrophotographic element comprising at least an insulative photoconductive layer and an electrically conductive substrate. The electrostatic latent image is usually formed by imagewise radiation-induced discharge of a uniform potential previously formed on the surface. Typically, the electrostatic latent image is then developed into a toner image by bringing an electrographic developer into contact with the latent image. If desired, the latent image can be transferred to another surface before development.

In latent image formation the imagewise discharge is brought about by the radiation-induced creation of pairs of negative-charge electrons and positive-charge holes, which are generated by a material (often referred to as a charge-generation material) in the electrophotographic element in response to exposure to the imagewise actinic radiation. Depending upon the polarity of the initially uniform electrostatic potential and the types of materials included in the electrophotographic element, either the holes or the electrons that have been generated, migrate toward the charged surface of the element in the exposed areas and thereby cause the imagewise discharge of the initial potential. What remains is a non-uniform potential constituting the electrostatic latent image.

Among the many different kinds of materials known to be useful as charge-generation materials in electrophotographic elements are pigments such as titanyl fluorophthalocyanines. See, for example, U.S. Pat. Nos. 5,055,368 and 4,701,396 and copending U.S. patent application Ser. No. 07/533,634 (filed Jun. 5, 1990). Such pigments are known to be capable of generating electron/hole pairs in response to exposure to red and/or near-infrared radiation (i.e., radiation having significant intensity at a wavelength within the range of 600 to 900 nanometers). Such sensitivity to red and/or near-infrared radiation is especially useful when it is desired to use light sources, such as light-emitting diode arrays or lasers, having major output in the red or near-infrared regions, to cause discharge of an electrically charged electrophotographic element.

It has also been recognized that generally known methods of synthesizing titanyl fluorophthalocyanines can yield crude forms of such pigments which are not as highly sensitive to red or near-infrared radiation as desired. The prior art has disclosed various methods of treating such crude pigments to improve their red and/or near-infrared sensitivity. For example, U.S. Pat. No. 4,701,396 discloses a method referred to therein as "acid-pasting", and U.S. Pat. No. 5,055,368 discloses a method that we will refer to as "salt-milling". Both of these methods are effective to improve the red or near-infrared photosensitivity of crude titanyl fluorophthalocyanines.

The disclosures of U.S. Pat. Nos. 4,701,396 and 5,055,368 also illustrate that when, after treatment by such referred-to methods, the pigments are dispersed in a coating solution of a polymeric binder and an organic solvent such as dichloromethane or trichloroethane, and the resulting coating composition is employed to form a photoconductive layer in an electrophotographic element, the electrophotographic element exhibits relatively high photosensitivity to near-infrared radiation.

Because of environmental concerns with the industrial use of certain solvents, such as chlorinated hydrocarbons (e.g., dichloromethane and trichloroethane), it would be desirable to form photoconductive layers from coating compositions containing other solvents, instead, such as, e.g., acetone, tetrahydrofuran, or alcohols such as methanol, ethanol, or 2-ethoxyethanol. However, the present inventors have found that if crude titanyl fluorophthalocyanines are treated to improve their red and near-infrared photosensitivity by methods such as the aforementioned acid-pasting or salt-milling processes and are then dispersed in a coating solution containing an organic solvent such as methanol or tetrahydrofuran, instead of a solvent such as dichloromethane or trichloroethane (sometimes alternatively referred to as "DCM" and "TCE", respectively), electrophotographic elements containing a photoconductive layer formed from such a coating composition will exhibit much lower photosensitivity to red and near-infrared radiation. The present inventors have found, further, that such adverse effects on photosensitivity are apparently caused by bringing the pigments into contact with a solvent such as methanol or tetrahydrofuran after they have been treated to improve their photosensitivity by a method such as, e.g., acid-pasting or salt-milling, because they have found that bringing the pigments into contact with tetrahydrofuran before acid-pasting or salt-milling does not adversely affect the photosensitivity achieved by subsequent acid-pasting or salt-milling. The present inventors have also found that the adverse effect of contact with a solvent such as tetrahydrofuran after acid-pasting or salt-milling appears to be relatively persistent. For example, the present inventors have found that if the pigment has been adversely affected by such contact, and the pigment is then removed from contact with the solvent that caused the adverse effect and is then dispersed in a coating solution of a polymeric binder and an organic solvent such as, e.g., dichloromethane or trichloroethane, which is then employed to form a photoconductive layer in an electrophotographic element, the electrophotographic element will still exhibit the adversely lower red and near-infrared photosensitivity.

Through further investigation, experimentation, and analysis, the present inventors have found that many other solvents, not just methanol or tetrahydrofuran (sometimes alternatively referred to as "THF"), will also cause the problem, e.g., other alcohols, acetone, N-methylpyrrolidone, diglyme, dioxane, N,N-dimethylformamide (sometimes alternatively referred to as "DMF"), pyridine, quinoline, morpholine, and ethylene glycol. More broadly, the present inventors have been able to characterize the "problem" solvents as organic solvents having a gamma$_c$ hydrogen bonding parameter value greater than 9.0. I.e., if a crude titanyl fluorophthalocyanine pigment as synthesized is subjected to acid-pasting or salt-milling to increase its red and near-infrared photosensitivity and is then brought into contact with an organic solvent having a gamma$_c$ hydrogen bonding parameter value greater than 9.0, its red and near-infrared photosensitivity will be significantly and persistently reduced. The gamma$_c$ hydrogen bonding parameter value of an organic solvent is a measure of the proton-attracting power of the solvent. It is defined by J. D. Crowley, G. S. Teague, and J. W. Lowe in their paper entitled "A Three-Dimensional Approach to Solubility", published in the *Journal of Paint Technology,* Vol. 38, No. 496, May 1966, pp. 269-280, and has been accepted as a standard test of solvents, as described, for example, in the *CRC Handbook of Solubility Parameters and Other Cohesion Parameters,* by A. Barton, CRC Press Boca Raton, Fla. 1983 pp. 174 and 179-180 and in the ASTM D3132 standard test method.

Since many otherwise desirable coating solvents have a gamma$_c$ hydrogen bonding parameter value greater than 9.0, the present inventors were faced with the problem of providing a coating composition, comprising a solution of such a solvent and a polymeric binder, having dispersed therein a titanyl fluorophthalocyanine pigment that has been acid-pasted or salt-milled to increase its photosensitivity, without substantially adversely lowering such increased photosensitivity.

SUMMARY OF THE INVENTION

The present inventors have unexpectedly found that if a titanyl fluorophthalocyanine pigment has been acid-pasted or salt-milled to increase its photosensitivity, the increased photosensitivity of the pigment can be preserved by bringing the pigment into contact with an organic solvent having a gamma$_c$ hydrogen bonding parameter value less than 8.0. Thereafter, bringing the pigment into contact with a solvent such as THF will not substantially adversely lower the increased photosensitivity of the pigment.

Thus, the invention solves the above-noted problem by providing a coating composition comprising a coating solution of a polymeric binder and an organic solvent having a gamma$_c$ hydrogen bonding parameter value greater than 9.0, the coating solution having dispersed therein a titanyl fluorophthalocyanine pigment which has been acid-pasted or salt-milled to increase its photosensitivity and then has been brought into contact with an organic solvent having a gamma$_c$ hydrogen bonding parameter value less than 8.0 to preserve its increased photosensitivity, prior to the pigment's being dispersed in the coating solution.

DESCRIPTION OF THE PREFERRED EMBODIMENTS

The only essential differences of coating compositions of this invention from coating compositions known to be useful to form photoconductive layers in electrophotographic elements reside in the titanyl fluorophthalocyanine pigments dispersed in the compositions and, in some cases, the organic solvent included therein. In virtually all other respects in regard to materials, proportions, preparation, and use, the coating compositions can be the same as other coating compositions described in the prior art as useful to form a photoconductive layer in an electrophotographic element. For detailed descriptions of those aspects that coating compositions of the invention have in common with other coating compositions useful for forming photoconductive layers see, for example, U.S. Pat. Nos. 3,041,166; 3,165,405; 3,394,001; 3,615,414; 3,679,405; 3,725,058; 4,175,960; 4,284,699; 4,514,481; 4,578,334; 4,666,802; 4,701,396; 4,719,163; 4,840,860; 5,019,473; and 5,055,368, the disclosures of which are hereby incorporated herein by reference. A partial listing of materials that coating compositions of this invention can have in common with coating compositions known to be useful to form photoconductive layers includes, for example, polymeric binders, other charge-generation materials, charge-transport materials, leveling agents, surfactants, plasticizers, sensitizers, contrast-control agents, and release agents.

Titanyl fluorophthalocyanine pigments that can be included in coating compositions of the invention have the structure

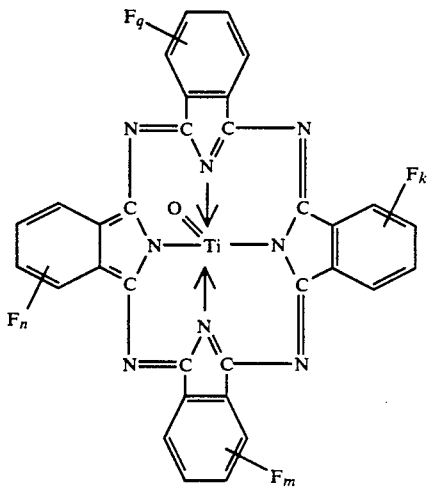

(I)

wherein each of k, m, n, and q is independently an integer from 0 to 4, and at least one of k, m, n, and q is an integer from 1 to 4. In some preferred embodiments of the invention the pigment is a titanyl tetrafluorophthalocyanine (sometimes hereinafter alternatively referred to as "$TiOF_4Pc$"), i.e., a pigment of Structure (I), wherein k, m, n, and q are each 1. In a particularly preferred embodiment the pigment is titanyl 2,9,16,23-tetrafluorophthalocyanine.

Titanyl fluorophthalocyanines useful in the invention can be synthesized by any of the procedures well known therefor, for example, as described in U.S. Pat. No. 4,701,396, to yield a crude form of the pigment. The crude pigment is then subjected to a process such as acid-pasting or salt-milling to reduce its particle size and increase its photosensitivity to red and near-infrared radiation.

As used herein, the term, "acid-pasting", is intended to refer to a method, such as disclosed in U.S. Pat. No. 4,701,396, comprising dissolving the pigment (after extraction purification with a solvent such as DMF) in cold concentrated mineral acid (e.g., sulfuric acid), pouring the resultant solution into ice water to reprecipitate the pigment, collecting the pigment, washing the pigment free of acid with an appropriate liquid such as water (for purposes of the present invention, an organic solvent having a $gamma_c$ hydrogen bonding parameter value greater than 9.0, such as methanol, is not an appropriate washing liquid for this step), and drying the pigment See U.S. Pat. No. 4,701,396 for more detailed description.

As used herein, the term, "salt-milling", is intended to refer to a method, such as disclosed in U.S. Pat. No. 5,055,368, comprising: milling the pigment with milling media comprising a mixture of an inorganic salt (e.g., sodium chloride) and electrically non-conducting particles (e.g., glass beads) under shear conditions in the substantial absence of binder and solvent to reduce the pigment average particle size to about 0.2 micrometer or less; continuing the milling at higher shear and at a temperature up to about 50° C. to achieve a perceptible color change in the pigment particles; rapidly increasing the temperature of milled pigment by at least 10° C.; and separating the pigment from the milling media. See U.S. Pat. No. 5,055,368 for more detailed description.

Methods such as acid-pasting or salt-milling apparently alter the pigment's crystalline structure and thereby render it more photosensitive, especially to red and near-infrared radiation.

In order to preserve the increased photosensitivity achieved by such methods, the pigment is then brought into contact with an organic solvent having a $gamma_c$ hydrogen bonding parameter value less than 8.0, before the pigment comes into contact with any organic solvent having a $gamma_c$ hydrogen bonding parameter value greater than 9.0.

$Gamma_c$ hydrogen bonding parameter values of organic solvents can be determined by the method of Crowley, Teague, and Lowe, reported in "A Three-Dimensional Approach to Solubility", J. D Crowley, G. S. Teague, and J. W. Lowe, *Journal of Paint Technology*, Vol. 38, No. 496, May 1966, pp. 269–280 and further described in *CRC Handbook of Solubility Parameters and Other Cohesion Parameters.* A. Barton, CRC Press, Boca Raton, Fla., 1983, pp. 174 and 179–180 and in the ASTM D3132 standard test method. The method comprises measuring the effect of the solvent on deuterated methanol in terms of the frequency of the infrared radiation absorbed by the O-D bond of deuterated methanol and comparing that effect to the effect of benzene on the same bond. The value of the $gamma_c$ hydrogen bonding parameter for the solvent being tested is then determined in accordance with the equation $$gamma_c = [(nu_{benzene}) - (nu_{solvent})]/10$$

wherein "$nu_{benzene}$" is the wave number (expressed as $cm^{-1}$) of the infrared radiation absorbed by the O-D bond of deuterated methanol in contact with benzene, and "$nu_{solvent}$" is the wave number of the infrared radiation absorbed by the O-D bond of deuterated methanol in contact with the solvent being tested.

$Gamma_c$ hydrogen bonding parameter values of numerous well known organic solvents have been determined. A list of some of such solvents and values is presented in Table I.

TABLE I

| Solvent | $Gamma_c$ hydrogen bonding parameter value |
|---|---|
| benzene | 0.0 |
| dichloromethane | 1.5 |
| 1,1,2-trichloroethane | 1.5 |
| chlorobenzene | 1.5 |
| dichloropropane | 1.5 |

TABLE I-continued

| Solvent | $Gamma_c$ hydrogen bonding parameter value |
|---|---|
| chloroform | 1.5 |
| ethylene dichloride | 1.5 |
| toluene | 4.5 |
| xylene | 4.5 |
| acetonitrile | 6.3 |
| methyl benzoate | 6.3 |
| anisole | 7.0 |
| diethyl ketone | 7.7 |
| methyl ethyl ketone | 7.7 |
| methyl isobutyl ketone | 7.7 |
| acetone | 9.7 |
| butyrolactone | 9.7 |
| dioxane | 9.7 |
| tetrahydrofuran | 9.9 |
| cyclohexanone | 11.7 |
| N,N-dimethylformamide | 11.7 |
| 2-ethoxyethanol | 13.0 |
| ethanol | 18.7 |
| methanol | 18.7 |
| butanol | 18.7 |
| pyridine | 18.1 |
| ethylene glycol | 20.6 |

To treat the pigment with an organic solvent having a $gamma_c$ hydrogen bonding parameter value less than 8.0, any convenient procedure can e used. For example, the pigment can be contacted with vapors of the solvent, or it can be simply mixed well with the liquid solvent, or it can be milled in mixture with the solvent and typical milling media, such as, e.g., steel shot. If it is not objectionable to have a small amount of solvent having $gamma_c$ value less than 8.0 in the final coating solution, perhaps the most convenient procedure is to mill the pigment with milling media, solvent having $gamma_c$ value less than 8.0, and the correct proportion of the polymeric binder desired for the layer; thereafter, the dispersion of pigment in binder/solvent solution can be simply mixed with the proper proportion of the desired organic solvent having a $gamma_c$ hydrogen bonding parameter value greater than 9.0 to form a useful coating solution. For the purpose of preserving high photosensitivity of the pigment, it does not matter whether the pigment remains in contact with some of the solvent having $gamma_c$ value less than 8.0 or is completely separated from such solvent after the treatment. In either case the invention still provides the advantage of being able to use a solvent with $gamma_c$ value greater than 9.0 (such as THF) as the main coating solvent. Therefore, if desired, the pigment can be completely separated from the solvent having $gamma_c$ value less than 8.0 after the treatment and before dispersing the treated pigment in coating solution of polymeric binder and solvent having $gamma_c$ value greater than 9.0, in order to keep the final coating solution completely free of solvent having $gamma_c$ value less than 8.0.

The amount of solvent having $gamma_c$ value less than 8.0 that is brought into contact with the pigment is not critical, although it should be appreciated that it is preferred that the amount be large enough to allow continuous contact of all surfaces of the pigment particles with the solvent during the treatment in order to maximize treatment uniformity and efficiency. In this regard, it is also preferred that procedures, such as agitating or stirring a mixture of the pigment particles and liquid solvent during the treatment, be followed in order to facilitate contact of all surfaces of the pigment particles with the solvent. Also, it appears that solvents with gamma$_c$ values less than 7.0 enable more efficient treatment (indeed, in general, the lower the gamma$_c$ value, the more efficient the treatment), and it is therefore preferred that the organic solvent having a gamma$_c$ hydrogen bonding parameter value less than 8.0, that is employed for the treatment, be an organic solvent having a gamma$_c$ hydrogen bonding parameter value less than 7.0.

The duration of the contact between the pigment and the solvent with gamma$_c$ value less than 8.0, necessary to maximize the beneficial effect of the treatment, will vary depending upon the nature of the pigment and the solvent, the pigment particle size and shape, the procedure employed to effect the contact, the temperature at which the contacting is carried out, and probably other factors. There is generally no critical need to operate above room temperature; however, operating at elevated temperature may allow the duration of contact to be shortened. In some particular embodiments of the invention maximum benefits appear to have been generally achieved, for example, by mixing the pigment particles with the liquid phase of an organic solvent having gamma$_c$ value less than 8.0 and ultrasonically agitating the mixture at 60° C. for 2 hours or by milling the pigment with the solvent and steel shot for 2 days without any external application of heat.

While the reasons or mechanisms for the beneficial effect of the contact with solvent having gamma$_c$ value less than 8.0 are not understood, it does appear that the treatment establishes a certain crystalline structure in the pigment which is not adversely affected by subsequent contact with an organic solvent having a gamma$_c$ hydrogen bonding parameter value greater than 9.0. For example, an acid-pasted $TiOF_4Pc$ pigment, which has not been treated thereafter with an organic solvent, has been found to exhibit major x-ray diffractogram peaks (obtained with CuK alpha radiation) at Bragg angles ($2\theta \pm 0.2$) and with relative intensities (i), as listed in Table II.

TABLE II

| $TiOF_4Pc$:acid-pasted and not treated | |
|---|---|
| $2\theta \pm 0.2$ | i |
| 6.5 | 100 |
| 9.4 | 4 |
| 12.6 | 4 |
| 15.2 | 4 |
| 15.6 | 7 |
| 23.6 | 13 |
| 26.2 | 26 |

The same acid-pasted $TiOF_4Pc$ pigment, which thereafter has been brought into contact with an organic solvent having a gamma$_c$ value less than 8.0 (e.g., DCM), has been found to exhibit major x-ray diffractogram peaks (obtained with CuK alpha radiation) at Bragg angles ($2\theta \pm 0.2$) and with relative intensities (i), as listed in Table III, and it thereafter exhibits high red and near-infrared photosensitivity in a photoconductive layer of an electrophotographic element, no matter whether the photoconductive layer was formed from a coating solution containing an organic solvent having a gamma$_c$ hydrogen bonding parameter value less than 8.0 or greater than 9.0.

TABLE III

| $TiOF_4Pc$:acid-pasted and DCM-treated | |
|---|---|
| $2\theta \pm 0.2$ | i |
| 6.6 | 60 |

TABLE III-continued

| $TiOF_4Pc$:acid-pasted and DCM-treated | |
|---|---|
| $2\theta \pm 0.2$ | i |
| 7.1 | 58 |
| 9.8 | 3 |
| 11.6 | 6 |
| 12.9 | 6 |
| 14.9 | 6 |
| 15.8 | 24 |
| 18.2 | 2 |
| 20.7 | 4 |
| 23.2 | 6 |
| 24.3 | 6 |
| 27.0 | 100 |
| 31.0 | 5 |
| 32.5 | 3 |
| 34.5 | 2 |
| 37.1 | 4 |

On the other hand, an acid-pasted $TiOF_4Pc$ pigment which, after acid-pasting, has been brought into contact with an organic solvent having a gamma$_c$ value greater than 9.0 (e.g., acetone) yields a different diffractogram pattern obtained with CuK alpha radiation, i.e., with major peaks at Bragg angles ($2\theta \pm 0.2$) and with relative intensities (i), as listed in Table IV, and it thereafter exhibits much lower red and near-infrared photosensitivity in a photoconductive layer of an electrophotographic element, no matter whether the photoconductive layer was formed from a coating solution containing an organic solvent having a gamma$_c$ value less than 8.0 or greater than 9.0.

TABLE IV

| $TiOF_4Pc$:acid-pasted and acetone-treated | |
|---|---|
| $2\theta \pm 0.2$ | i |
| 6.6 | 100 |
| 9.4 | 13 |
| 13.0 | 1 |
| 15.0 | 28 |
| 21.3 | 3 |
| 23.4 | 30 |
| 24.3 | 24 |
| 25.3 | 16 |
| 26.9 | 6 |
| 27.9 | 3 |
| 28.9 | 1 |
| 30.6 | 2 |
| 34.1 | 3 |
| 34.7 | 2 |
| 36.7 | 2 |

After treatment of the pigment with an organic solvent having a gamma$_c$ value less than 8.0, the pigment can be separated from or remain in contact with such solvent, as previously mentioned. The pigment is then dispersed in a coating solution of a polymeric binder and an organic coating solvent having a gamma$_c$ hydrogen bonding parameter value greater than 9.0, such as, e.g., THF, by any desired method known to be suitable therefor, e.g., by milling the pigment with the solution of polymeric binder and coating solvent in a ball mill for several days and diluting the dispersion to a suitable coating viscosity with additional coating solvent.

The thus formed coating composition in accordance with the invention can be advantageously employed in any known solvent coating method to form a photoconductive layer in an electrophotographic element having high photosensitivity to red and near-infrared radiation, or it can be employed to form layers useful for other purposes, e.g., information recording layers that utilize near-infrared radiation to record information by causing fusing, vaporization, sublimination or other phase transformations of materials in the layers, such as described, for example, in U.S. Pat. No. 4,458,004.

As previously mentioned, the polymeric binder included in a coating composition of this invention can comprise any of the polymers known to be useful in photoconductive layers in general, i.e., film-forming polymers having fairly high dielectric strength and good electrically insulating properties such as are well known in the prior art, e.g., U.S. Pat. Nos. 4,701,396 and 5,055,368. When the coating composition is intended to be used for purposes other than to form photoconductive layers (e.g., purposes such as described in U.S. Pat. No. 4,458,004), further types of polymers will also be suitable, e.g., those not having high dielectric strength or good electrically insulating properties.

Photoconductive layers that can be formed with coating compositions of the invention can be incorporated in electrophotographic elements of various types, including both those commonly referred to as single layer or single-active-layer elements and those commonly referred to as multiactive, multilayer, or multiactive-layer elements.

Single-active-layer elements are so named, because they contain only one layer that is active both to generate and to transport charges in response to exposure to actinic radiation. Such elements typically comprise at least an electrically conductive layer in electrical contact with a photoconductive layer. In single-active-layer elements, the photoconductive layer contains a charge-generation material to generate electron/hole pairs in response to actinic radiation and a charge-transport material, which is capable of accepting charges generated by the charge-generation material and transporting them through the layer to effect discharge of the initially uniform electrostatic potential. The photoconductive layer is electrically insulative, except when exposed to actinic radiation, and sometimes contains an electrically insulative polymeric film-forming binder.

Multiactive elements are so named, because they contain at least two active layers, at least one of which is capable of generating charge (i.e., electron/hole pairs) in response to exposure to actinic radiation and is referred to as a charge-generation layer (also referred to as a CGL), and at least one of which is capable of accepting and transporting charges generated by the charge-generation layer and is referred to as a charge-transport layer (also referred to as a CTL). Such elements typically comprise at least an electrically conductive layer, a CGL, and a CTL. Either the CGL or the CTL is in electrical contact with both the electrically conductive layer and the remaining CGL or CTL. The CGL contains at least a charge-generation material; the CTL contains at least a charge-transport agent; and either or both layers can contain an electrically insulative film-forming polymeric binder.

Coating compositions in accordance with the invention can serve to form the single active photoconductive layer of a single-active-layer element or charge-generation layers in multiactive elements. In both cases the titanyl fluorophthalocyanine in the inventive coating composition will serve as at least one of the charge-generation materials in the element.

The only essential differences of electrophotographic elements, containing photoconductive layers formed with coating compositions of this invention, from known electrophotographic elements, reside in the titanyl fluorophthalocyanine pigments dispersed in the photoconductive layers and, in some cases, the organic solvent employed to coat such layers. In virtually all other respects in regard to materials, proportions, preparation, and use, the electrophotographic elements can be the same as other electrophotographic elements described in the prior art. For detailed descriptions of those aspects that electrophotographic elements containing photoconductive layers formed from coating compositions of the invention can have in common with other electrophotographic elements see, for example, U.S. Pat. Nos. 3,041,166; 3,165,405; 3,394,001; 3,615,414; 3,679,405; 3,725,058; 4,175,960; 4,284,699; 4,514,481; 4,578,334; 4,666,802; 4,701,396; 4,719,163; 4,840,860; 5,019,473; and 5,055,368. A partial listing of layers and components that electrophotographic elements containing photoconductive layers formed from coating compositions of this invention can have in common with known electrophotographic elements includes, for example: electrically conductive layers and supports bearing such conductive layers; charge-transport layers capable of accepting and transporting electrons or holes generated in charge-generation layers; charge generation layers in addition to those formed from coating compositions of this invention; optional subbing layers, barrier layers, and screening layers; polymeric binders; other charge-generation materials; charge-transport materials; leveling agents; surfactants; plasticizers; sensitizers; contrast-control agents; and release agents.

The following preparations and examples are presented to further illustrate some specific coating compositions of the invention and their advantageous utility in forming photoconductive layers in electrophotographic elements and to compare them to coating compositions outside the scope of the invention.

PREPARATION 1

Titanyl tetrafluorophthalocyanine ($TiOF_4Pc$)

4-Fluorophthalonitrile (38.7 g, 0.267 mole) and 20.7 g (0.134 mole) of titanium trichloride were suspended in 200 ml 1-chloronaphthalene and heated to 210°-215° C. (oil bath) and maintained for 2.5 hours at this temperature. The reaction mixture was cooled slightly, and the dark solid was collected and washed with acetone and methanol. After drying, the dark blue solid (34 g) was slurried twice in refluxing dimethylformamide, filtered hot each time and washed with acetone to yield the $TiOF_4Pc$ pigment.

PREPARATION 2

Acid-pasted $TiOF_4Pc$

The blue solid of Preparation 1 was dissolved in concentrated sulfuric acid with cooling, stirred for one hour at room temperature, and filtered through a coarse frit Buchner funnel. The acid filtrate was added to 2 liters of ice and water mixture with stirring. The bright blue solid that separated was collected, washed free of acid with water and dried to yield the acid-pasted $TiOF_4Pc$.

PREPARATION 3

Acid-pasted $TiOF_4Pc$ with water reflux

Most of the solid of Preparation 2 was ground in a mortar with a pestle then added to water and refluxed. The water refluxing was repeated, and the sample was isolated and dried to yield the acid-pasted $TiOF_4Pc$.

Preparations 2 and 3 together comprise a generally known acid-pasting procedure for titanyl fluorophthalocyanines, as described, e.g., in Example 2 of U.S. Pat. No. 4,701,396.

The peaks and relative intensities thereof in the x-ray diffractogram of the $TiOF_4Pc$ yielded by this preparation are listed in Table II, above.

PREPARATION 4

Acid-pasted $TiOF_4Pc$ plus methanol wash

A sample of the solid of Preparation 2 was redispersed in methanol ($gamma_c$=18.7), filtered, dried, redispersed in water, refluxed, and dried.

PREPARATION 5

Acid-pasted $TiOF_4Pc$ plus acetone wash

A sample of the solid of Preparation 2 was redispersed in acetone ($gamma_c$=9.7), filtered, dried, redispersed in water, refluxed, and dried.

The peaks and relative intensities thereof in the x-ray diffractogram of the $TiOF_4Pc$ yielded by this preparation are listed in Table IV, above.

PREPARATION 6

Acid-pasted $TiOF_4Pc$ plus MIBK premilling

Five grams of the solid of Preparation 3 were mixed with about 60 ml of methyl isobutyl ketone (alternatively referred to as MIBK) ($gamma_c$=7.7) and about 20 grams of steel shot. No binder resin was present. The sample was ball-milled for three days, isolated and dried.

PREPARATION 7

Acid-pasted $TiOF_4Pc$ plus TCE premilling

The procedure of Preparation 6 was carried out, except that the solvent was 1,1,2-trichloroethane (TCE)($gamma_c$=1.5).

PREPARATION 8

Acid-pasted $TiOF_4Pc$ plus MEK premilling

The procedure of Preparation 6 was carried out, except that the solvent was methyl ethyl ketone (alternatively referred to as MEK)($gamma_c$=7.7)

PREPARATION 9

Acid-pasted $TiOF_4Pc$ plus DCM premilling

The procedure of Preparation 6 was followed, except that the solvent was dichloromethane (DCM) ($gamma_c$=1.5), and the acid-pasted sample was from a different reaction batch.

The peaks and relative intensities thereof in the x-ray diffractogram of the $TiO_4Pc$ yielded by this preparation are listed in Table III, above.

PREPARATION 10

Salt-milled $TiOF_4Pc$

Crude $TiOF_4Pc$ was salt-milled in accordance with the procedure of Example 1 of U.S. Pat. No. 5,055,368.

PREPARATION 11

Acid-pasted and salt-milled $TiOF_4Pc$ $TiOF_4Pc$ was acid-pasted in accordance with Preparations 2 and 3 and then salt-milled in accordance with Preparation 10.

PREPARATION 12

Salt-milled TiOPc

Unsubstituted titanyl phthalocyanine (alternatively referred to as TiOPc) was salt-milled in accordance with the procedure of Example 2 of U.S. Pat. No. 5,055,368.

PREPARATION 13

Pigment dispersion

Pigment dispersions were prepared by adding 1 g of a designated pigment (from Preparation 3, 4, 5, 6, or 7) and 1 g of a bisphenol A polycarbonate binder (sold under the trademark, Makrolon 5705, by Mobay Chemical Co., USA) in a container to 25 g of DCM solvent and milling with steel shot for 3 days. The dispersion was separated from the steel shot and diluted with an additional 10 g of DCM.

PREPARATION 14

Coating composition for a charge-generation layer

A dye solution was prepared by dissolving 1.28 grams of 4-(p-dimethylaminophenyl)-2,6-diphenylthiapyrylium hexafluorophosphate, and 0.32 gram 4-(p-dimethylaminophenyl)-2-(4-ethoxyphenyl)-6-pheylthiapyrylium fluoroborate, two aggregating dyes, in a mixture of 103 grams of dichloromethane and 92 grams of 1,1,2-trichloroethane in a container and stirring for four hours. 8 g of the charge transport material, tri-4-tolylamine, was added to the container and stirring was continued for 0.5 hour. Then 145 g of aggregating bisphenol A polycarbonate (sold by General Electric Co., USA, under the trademark, "Lexan 145") and 0.4 g of poly(ethylene-co-neopentylene terephthalate), having a glycol molar ratio of 55:45, were added to the container and stirring was continued for 12 hours. The aggregate mixture was filtered through a 2.5 micrometer filter. Finally the pigment dispersion of Preparation 13 was added to the container, and stirring was continued to form a coating dope.

PREPARATION 15

Multiactive electrophotographic element

The coating dope of Preparation 14 was coated on a conductive support comprising a thin layer of aluminium on poly(ethylene terephthalate) substrate to provide a charge-generation layer having a dry thickness of 5 micrometers.

The charge-generation layer was overcoated with a charge transport layer dope solution comprising: 168 g of a polyester formed from 4,4'-(2-norbornylidene)diphenol and a 40/60 molar ratio of terephthalic/azelaic acids; 53.2 g of 1,1-bis[4-(di-4-tolylamino)phenyl]cyclohexane, a charge transport material; 53.2 g of tri-4-tolylamine, another charge-transport material; 5.6 g of 4,4'-bis(diethylamino)tetraphenylmethane, yet another charge-transport material; 1.72 kg of toluene; and 0.06 g of a siloxane surfactant sold under the trademark, DC510, by Dow Corning, USA. The thickness of the dried charge transport layer was 17 micrometers.

CONTROL EXAMPLES A-E

Multiactive elements of Preparation 15 were tested for red and near-infrared photosensitivity by electrostatically corona-charging the element to an initial potential of −500 volts and exposing the element to low intensity radiation having a wavelength of 680 nm or 780 nm, in an amount sufficient to photoconductively discharge the initial potential down to a level of −100 volts. Photosensitivity was measured in terms of the amount of incident actinic radiant energy (expressed in ergs/cm$^2$) needed to discharge the initial voltage down to the desired level. The lower the amount of radiation needed to achieve the desired degree of discharge, the higher is the photosensitivity of the element.

The preparation sequences and photosensitivities of electrophotographic elements of Control Examples A–E are presented in Table V.

TABLE V

| | | Elements in accordance with Preparation 15 | | | | |
|---|---|---|---|---|---|---|
| | | Preparation Sequence | | | Photosensitivity (amount of radiant energy required) (ergs/cm$^2$) | |
| Example | Pigment | Preparation number | Organic solvent(s) employed | Gamma$_c$ of solvent(s) employed | 780 nm | 680 nm |
| Control A | $TiOF_4Pc$ | 3 | — | — | | |
| | | 13 | DCM | 1.5 | | |
| | | 14 | DCM, TCE | 1.5, 1.5 | 5.5 | 4.8 |
| Control B | $TiOF_4Pc$ | 4 | methanol | 18.7 | | |
| | | 13 | DCM | 1.5 | | |
| | | 14 | DCM, TCE | 1.5, 1.5 | 16.3 | 4.8 |
| Control C | $TiOF_4Pc$ | 5 | acetone | 9.7 | | |
| | | 13 | DCM | 1.5 | | |
| | | 14 | DCM, TCE | 1.5, 1.5 | 7.5 | 5.2 |
| Control D | $TiOF_4Pc$ | 3 | — | — | | |
| | | 6 | MIBK | 7.7 | | |
| | | 13 | DCM | 1.5 | | |
| | | 14 | DCM, TCE | 1.5, 1.5 | 6.5 | 4.4 |
| Control E | $TiOF_4Pc$ | 3 | — | — | | |
| | | 7 | TCE | 1.5 | | |
| | | 13 | DCM | 1.5 | | |
| | | 14 | DCM, TCE | 1.5, 1.5 | 6.0 | 4.4 |

The data presented in Table V provide a good illustration of the problem, recognized by the present inventors, that the present invention solves. Namely, when a $TiOF_4Pc$ pigment was acid-pasted, and, thereafter, the first organic solvent the pigment came into contact with had a gamma$_c$ value greater than 9.0 (Control Examples B and C), the red or near-infrared photosensitivity of an electrophotographic element containing the pigment as a charge-generation material was lower (i.e., amount of radiant energy required for desired amount of discharge was higher) than when the element contained a $TiOF_4Pc$ pigment that, after acid-pasting, had first come into contact with an organic solvent having a gamma$_c$ value less than 8.0 (Control Examples A, D, and E). The data also illustrates the present inventors' finding that, generally, the higher above 9.0 that gamma$_c$ of the first solvent is, the worse is the adverse effect of the solvent on pigment photosensitivity, and that, generally, the lower below 8.0 that gamma$_c$ of the first solvent is, the better is the beneficial effect of the solvent on pigment photosensitivity.

PREPARATION 16

Coating composition for forming a charge-generation layer

Pigment dispersions were prepared by adding 1 g of a designated pigment (from Preparation 3, 7, 8, 9, or 11) and 1 g of a bisphenol A polycarbonate binder (sold under the trademark, Makrolon 5705, by Mobay Chemical Co., USA) in a container to 25 g of DCM or THF solvent and milling with steel shot for 3 days. The dispersion was separated from the steel shot and then mixed with an additional 49.5 g of DCM or THF, 0.15 g of 1,1-bis[4-(di-4-tolylamino)phenyl]cyclohexane charge-transport agent, and 0.15 g of tri-4-tolylamine charge-transport agent to form a coating composition.

PREPARATION 17

Electrophotographic element

The coating composition of Preparation 16 was stirred for 2 hours and then coated onto a cylindrical aluminum drum substrate that had been previously overcoated with a 0.1 micrometer-thick barrier layer of a polyamide (sold under the trademark, Amylan CM800, by Toray Inc., Japan). The coating composition of Preparation 16 was coated onto the barrier layer with a ring coating apparatus at a speed of 0.762 cm/sec to create a 0.5 micrometer-thick charge-generation layer.

The charge-generation layer was then overcoated with the charge-transport layer dope solution described in Preparation 15 (except that 0.56 g, instead of 5.6 g, of 4,4'-bis(diethylamino)tetraphenylmethane charge-transport material was included in the dope solution), by means of a ring coating apparatus at a speed of 1.27 cm/sec.

EXAMPLES 1–3 AND CONTROL EXAMPLES F–I

Electrophotographic elements of Preparation 17 were tested for photosensitivity by electrostatically corona-charging the element to an initial potential of −500 volts and exposing the element to low intensity radiation having a wavelength of 540 nm 600 nm, 680 nm, or 780 nm, in an amount sufficient to photoconductively discharge the initial potential down to a level of −100 volts. Photosensitivity was measured in terms of the amount of incident actinic radiant energy (expressed in ergs/cm$^2$) needed to discharge the initial voltage down to the desired level. The lower the amount of radiation needed to achieve the desired degree of discharge, the higher is the photosensitivity of the element.

The preparation sequences and photosensitivities of electrophotographic elements of Examples 1–3 and Control Examples F–I are presented in Table VI.

TABLE VI

| Example | Pigment | Elements in accordance with Preparation 17 — Preparation Sequence: Preparation number | Organic solvent(s) employed | Gamma$_c$ of solvent(s) employed | Photosensitivity (amount of radiant energy required) (ergs/cm$^2$): 780 nm | 680 nm | 600 nm | 540 nm |
|---|---|---|---|---|---|---|---|---|
| Control F | $TiOF_4Pc$ | 3 | — | — | | | | |
| | | 16 | DCM | 1.5 | 8.5 | 8.3 | 10.3 | 16.6 |
| Control G | $TiOF_4Pc$ | 3 | — | — | | | | |
| | | 16 | THF | 9.9 | 31.5 | 37.4 | 44.7 | 99.0 |
| 1 | $TiOF_4Pc$ | 3 | — | — | | | | |
| | | 9 | DCM | 1.5 | | | | |
| | | 16 | THF | 9.9 | 7.0 | 9.5 | 12.0 | 17.1 |
| 2 | $TiOF_4Pc$ | 3 | — | — | | | | |
| | | 8 | MEK | 7.7 | | | | |
| | | 16 | THF | 9.9 | 8.0 | 9.9 | 15.0 | 22.5 |
| 3 | $TiOF_4Pc$ | 3 | — | — | | | | |
| | | 7 | TCE | 1.5 | | | | |
| | | 16 | THF | 9.9 | 7.5 | 9.1 | 12.9 | 20.3 |
| Control H | $TiOF_4Pc$ | 11 | — | — | | | | |
| | | 16 | DCM | 1.5 | 7.0 | 9.1 | 14.6 | 12.6 |
| Control I | $TiOF_4Pc$ | 11 | — | — | | | | |
| | | 16 | THF | 9.9 | 307 | 386 | 348 | 618 |

The data presented in Table VI illustrate the beneficial effect of coating compositions in accordance with the invention (employed in Examples 1, 2, and 3). Namely, when a $TiOF_4Pc$ pigment was acid-pasted, and, thereafter, the first organic solvent the pigment came into contact with had a gamma$_c$ value less than 8.0, the pigment could then be included in a coating composition containing an organic solvent having a gamma$_c$ value either greater than 9.0 (Examples 1, 2, and 3) or less than 8.0 (e.g., Control Example F), and an electrophotographic element containing a photoconductive layer formed from the coating composition then exhibited relatively high photosensitivity (i.e., amount of radiant energy required for desired amount of discharge was relatively low), especially to near-infrared radiation (e.g., 780 nm). In contrast, when the pigment was acid-pasted, and, thereafter, the first organic solvent the pigment came into contact with had a gamma$_c$ value greater than 9.0, an electrophotographic element containing a photoconductive layer formed from a coating composition containing the pigment (e.g., Control Example G) exhibited relatively low photosensitivity.

The data in Table VI also illustrate that the problem the invention solves also applies to $TiOF_4Pc$ pigments that have been acid-pasted and then salt-milled (compare Control Example I to Control Example H).

PREPARATION 18

Coating composition for forming a charge-generation layer

Pigment dispersions were prepared by adding 1 g of a designated pigment (from Preparation 3, 9, 10, or 12) and 1 g of a binder comprising a polyester, formed from 4,4'-(2-norbornylidene)diphenol and a 40/60 molar ratio of terephthalic/azelaic acids, to a container of 25 g of DCM or THF solvent and milling with steel shot for 3 days. The dispersion was separated from the steel shot and then mixed with an additional 110.23 g of DCM or 51.5 g of THF, 0.15 g of 1,1-bis[4-(di-4-tolylamino)-phenyl]cyclohexane charge-transport agent, and 0.15 g of tri-4-tolylamine charge-transport agent to form a coating composition.

PREPARATION 19

Electrophotographic element

The coating composition of Preparation 18 was stirred for 2 hours and then coated onto a cylindrical aluminum drum substrate that had been previously overcoated with a 0.1 micrometer-thick barrier layer of a polyamide (sold under the trademark, Amylan CM800, by Toray Inc., Japan). The coating composition of Preparation 18 was coated onto the barrier layer with a ring coating apparatus at a speed of 0.762 cm/sec to create a 0.4 micrometer-thick charge-generation layer.

The charge-generation layer was then overcoated with the charge-transport layer dope solution described in Preparation 15 (except that 0.56 g, instead of 5.6 g, of 4,4'-bis(diethylamino)tetraphenylmethane charge-transport material was included in the dope solution), by means of a ring coating apparatus at a speed of 1.27 cm/sec.

EXAMPLE 4 AND CONTROL EXAMPLES J-P

Electrophotographic elements of Preparation 19 were tested for photosensitivity by electrostatically corona-charging the element to an initial potential of −500 volts and exposing the element to low intensity radiation having a wavelength of 540 nm, 600 nm, 680 nm, or 780 nm, in an amount sufficient to photoconductively discharge the initial potential down to a level of −100 volts. Photosensitivity was measured in terms of the amount of incident actinic radiant energy (expressed in ergs/cm$^2$) needed to discharge the initial voltage down to the desired level. The lower the amount of radiation needed to achieve the desired degree of discharge, the higher is the photosensitivity of the element.

The preparation sequences and photosensitivities of electrophotographic elements of Example 4 and Control Examples J-P are presented in Table VII.

TABLE VII

| Example | Pigment | Elements in accordance with Preparation 19 — Preparation Sequence: Preparation number | Organic solvent(s) employed | Gamma$_c$ of solvent(s) employed | Photosensitivity (amount of radiant energy required) (ergs/cm$^2$): 780 nm | 680 nm | 600 nm | 540 nm |
|---|---|---|---|---|---|---|---|---|
| Control J | $TiOF_4Pc$ | 3 | — | — | | | | |
| | | 18 | DCM | 1.5 | 11.8 | 12.7 | 15.5 | 26.6 |
| Control K | $TiOF_4Pc$ | 3 | — | — | | | | |
| | | 18 | THF | 9.9 | 35.0 | 32.9 | 35.3 | 85.5 |
| Control L | $TiOF_4Pc$ | 3 | — | — | | | | |
| | | 9 | DCM | 1.5 | | | | |
| | | 18 | DCM | 1.5 | 8.75 | 9.5 | 13.3 | 22.5 |
| 4 | $TiOF_4Pc$ | 3 | — | — | | | | |
| | | 9 | DCM | 1.5 | | | | |
| | | 18 | THF | 9.9 | 6.3 | 7.1 | 9.9 | 15.8 |
| Control M | $TiOF_4Pc$ | 10 | — | — | | | | |
| | | 18 | DCM | 1.5 | 7.0 | 8.7 | 11.2 | 17.1 |
| Control N | $TiOF_4Pc$ | 10 | — | — | | | | |
| | | 18 | THF | 9.9 | 31.0 | 55.0 | 52.9 | 83.7 |
| Control O | TiOPc | 12 | — | — | | | | |
| | | 18 | DCM | 1.5 | 18.8 | 24.9 | 31.4 | 49.1 |
| Control P | TiOPc | 12 | — | — | | | | |
| | | 18 | THF | 9.9 | 15.0 | 18.2 | 17.2 | 27.0 |

The data presented in Table VII illustrate the beneficial effect of a coating composition in accordance with the invention (employed in Example 4). Namely, when a $TiOF_4Pc$ pigment was acid-pasted, and, thereafter, the first organic solvent the pigment came into contact with had a gamma$_c$ value less than 8.0, the pigment could then be included in a coating composition containing an organic solvent having a gamma$_c$ value either greater than 9.0 (Example 4) or less than 8.0 (e.g., Control Example L), and an electrophotographic element containing a photoconductive layer formed from the coating composition then exhibited relatively high photosensitivity (i.e., amount of radiant energy required for desired amount of discharge was relatively low). In contrast, when the pigment was acid-pasted, and, thereafter, the first organic solvent the pigment came into contact with had a gamma$_c$ value greater than 9.0, an electrophotographic element containing a photoconductive layer formed from a coating composition containing the pigment (e.g., Control Example K) exhibited relatively low, photosensitivity.

The data in Table VII also illustrate that the problem the invention solves also applies to $TiOF_4Pc$ pigments that have been salt-milled (compare Control Example N to Control Example M). However, the data also show that the problem the invention solves does not arise with unsubstituted TiOPc pigments that have been salt-milled (compare Control Example P to Control Example O).

The invention has been described in detail with particular reference to certain preferred embodiments thereof, but it should be appreciated that variations and modifications can be effected within the spirit and scope of the invention.

What is claimed is:

1. A coating composition comprising a coating solution of a polymeric binder and an organic solvent having a gamma$_c$ hydrogen bonding parameter value greater than 9.0, the coating solution having dispersed therein a titanyl fluorophthalocyanine pigment which has been acid-pasted or salt-milled to increase its photosensitivity and then has been brought into contact with an organic solvent having a gamma$_c$ hydrogen bonding parameter value less than 8.0 to preserve its increased photosensitivity, prior to the pigment's being dispersed in the coating solution.

2. The coating composition of claim 1, wherein the titanyl fluorophthalocyanine pigment has the structure

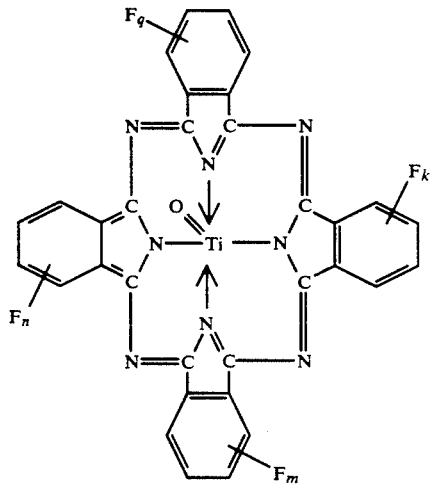

wherein each of k, m, n, and q is independently an integer from 0 to 4, and at least one of k, m, n, and q is an integer from 1 to 4.

3. The coating composition of claim 2, wherein each of k, m, n, and q is 1.

4. The coating composition of claim 1, wherein the organic solvent having a gamma$_c$ hydrogen bonding parameter value less than 8.0 has a gamma$_c$ hydrogen bonding parameter value less than 7.0.

5. The coating composition of claim 1, wherein the organic solvent having a gamma$_c$ hydrogen bonding parameter value less than 8.0 comprises dichloromethane, 1,1,2-trichloroethane, or methyl ethyl ketone.

6. The coating composition of claim 1, wherein the contact with an organic solvent having a gamma$_c$ hydrogen bonding parameter value less than 8.0 comprises milling the pigment in such solvent for 3 days without external application of heat thereto.

7. The coating composition of claim 1, wherein the organic solvent having a gamma$_c$ hydrogen bonding parameter value greater than 9.0 comprises tetrahydrofuran.

8. A coating composition comprising a coating solution of a polymeric binder and an organic solvent having a $gamma_c$ hydrogen bonding parameter value greater than 9.0, the coating solution having dispersed therein a titanyl fluorophthalocyanine pigment which exhibits major x-ray diffractogram peaks, obtained with CuK alpha radiation, at Bragg angles ($2\theta \pm 0.2$) of 6.6, 7.1, 9.8, 11.6, 12.9, 14.9, 15.8, 18.2, 20.7, 23.2, 24.3, 27.0, 31.0, 32.5, 34.5, and 37.1.

9. The coating composition of claim 8, wherein the organic solvent having a $gamma_c$ hydrogen bonding parameter value greater than 9.0 comprises tetrahydrofuran.

10. The coating composition of claim 8, wherein the titanyl fluorophthalocyanine pigment comprises titanyl tetrafluorophthalocyanine.

* * * * *